US006314716B1

(12) United States Patent
Abreu et al.

(10) Patent No.: US 6,314,716 B1
(45) Date of Patent: Nov. 13, 2001

(54) SERIAL COOLING OF A COMBUSTOR FOR A GAS TURBINE ENGINE

(75) Inventors: Mario E. Abreu, Poway; Janusz J. Kielczyk, Escondido, both of CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 09/465,026

(22) Filed: Dec. 16, 1999

Related U.S. Application Data

(60) Provisional application No. 60/112,706, filed on Dec. 18, 1998.

(51) Int. Cl.[7] ..... F02C 9/00

(52) U.S. Cl. ..... 60/39.03; 60/39.23; 60/39.27; 60/39.29; 60/39.37; 60/763

(58) Field of Search ..... 60/39.03, 763, 60/39.29, 39.27, 39.37, 39.23, 760, 39.12

(56) References Cited

U.S. PATENT DOCUMENTS

| | | | | |
|---|---|---|---|---|
| 4,050,238 | * | 9/1977 | Holzapfel | 60/39.23 |
| 4,719,748 | | 1/1988 | Davis, Jr. et al. . | |
| 4,763,481 | | 8/1988 | Cannon . | |
| 4,984,429 | * | 1/1991 | Waslo et al. | 60/752 |
| 5,687,572 | | 11/1997 | Schrantz et al. . | |
| 6,122,917 | * | 9/2000 | Senior | 60/752 |

* cited by examiner

*Primary Examiner*—Timothy S. Thorpe
*Assistant Examiner*—Eric Hayes
(74) *Attorney, Agent, or Firm*—Keith P. Roberson

(57) ABSTRACT

A combustor for a gas turbine engine uses compressed air to cool a combustor liner and uses at least a portion of the same compressed air for combustion air. A flow diverting mechanism regulates compressed air flow entering a combustion air plenum feeding combustion air to a plurality of fuel nozzles. The flow diverting mechanism adjusts combustion air according to engine loading.

10 Claims, 4 Drawing Sheets

SERIAL COOLING OF A COMBUSTOR FOR A GAS TURBINE ENGINE

This application claims the benefit of prior provisional patent application Ser. No. 60/112,706, filed Dec. 18, 1998.

"The Government of the United States of America has rights in this invention pursuant to Contract No. DE-FC21-95MC31173 awarded by the U.S. Department of Energy."

TECHNICAL FIELD

This invention relates generally to a gas turbine engine and more specifically to cooling of a combustor liner.

BACKGROUND ART

Current gas turbine engines continue to improve emissions and engine efficiencies. Notwithstanding these improvements, further increases in engine efficiencies will require more effective use of a mass of compressed air exiting a compressor. Gas turbine engines normally use the mass of compressed air for: 1) combustion air, 2) dilution air, 3) combustor cooling air, and 4) turbine component cooling air. Each use of the mass of compressed air may vary according to a load on the gas turbine engine. Generally each of these uses requires more of the mass of compressed air as the load increases.

In particular, combustion air and combustor cooling air have increased in importance with increasing regulations of NOx (an uncertain mixture of oxides of nitrogen). The efficiencies of the gas turbine engine usually improve with increased temperatures entering a turbine. Unlike the efficiency of the gas turbine engine, decreasing NOx production in gas turbine engines typically involves reducing a flame temperature. Lean premixed combustion attempts to decrease NOx production while maintaining gas turbine engine efficiencies. A lean premixed combustor premixes a mass of combustion air and a quantity of fuel upstream of a primary combustion zone. Increasing the mass of combustion air reduces the flame temperature by slowing a chemical reaction between the fuel and the combustion air. By reducing the flame temperature, NOx production also decreases.

Even with the lower flame temperatures, a liner wall of the combustor must be maintained at an operating temperature meeting a durability requirement. A number of cooling schemes may be used to cool the combustor liner including film cooling, convection cooling, effusion cooling, and impingement cooling. However, film cooling often times results in an increase in carbon monoxide (CO) production. Instead, many manufactures currently rely on backside cooling of combustor liners to reduce the production of CO.

At low engine loads, decreasing flame temperatures reduce requirements for cooling air and combustion air. The lower flame temperatures nonetheless lead to increased CO production and lower flame stability. Designing for both the high load and low load engine conditions generally results in very complex solutions. Typical designs focus on controlling the mass of combustion air to an individual injector. These controls require tight tolerances on dimensions of the injectors. Even with injectors having tight tolerances, the actuation of the injectors must be equally precise to avoid a mal distribution of combustion air entering the injectors.

The present invention is directed at overcoming one or more of the problems set forth above.

DISCLOSURE OF THE INVENTION

BEST MODE FOR CARRYING OUT THE INVENTION

Figure 1:
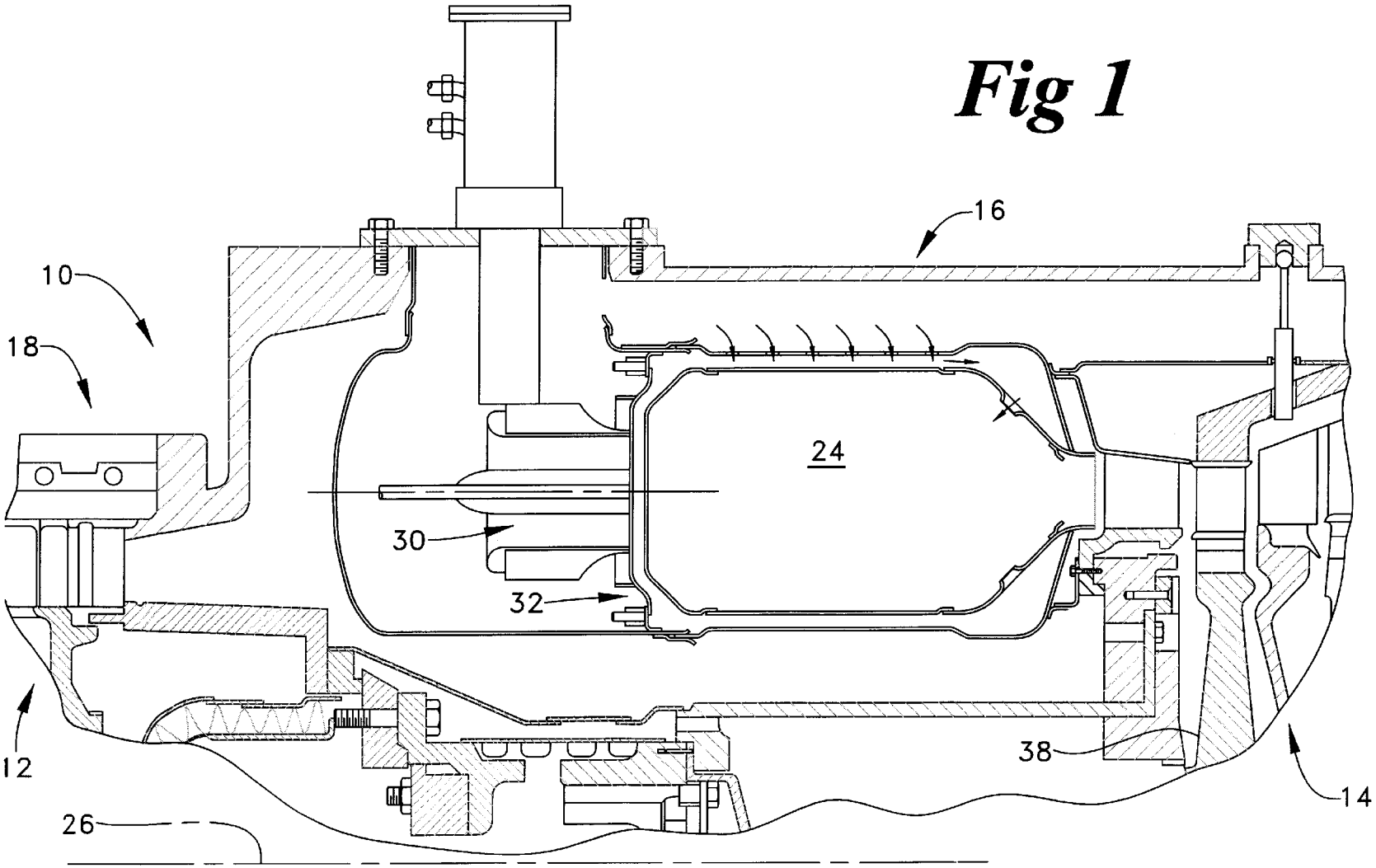
FIG. 1 is a partially sectioned partial view of a gas turbine engine embodying the present invention.

Referring to FIG. 1, a gas turbine engine 10 is shown but not in its entirety. The gas turbine engine 10 includes an air flow delivery system 12 for providing combustion air and for providing cooling air for cooling components of the engine 10. The engine 10 includes a turbine section 14, a combustor section 16, and a compressor section 18. The combustor section 16 and the compressor section 18 operatively connect to the turbine section 14. In this application the combustor section 16 includes an annular combustion chamber 24 positioned about a central axis 26 of the gas turbine engine 10. As an alternative the engine 10 could include a plurality of can combustors without changing the essence of the invention. The annular combustion chamber 24 is operatively positioned between the compressor section 18 and the turbine section 14. A plurality of fuel nozzles 30 (one shown) are positioned in an inlet end portion 32 of the annular combustion chamber 24. The turbine section 14 includes a first stage turbine 34 being centered about the central axis 26.

Figure 2:
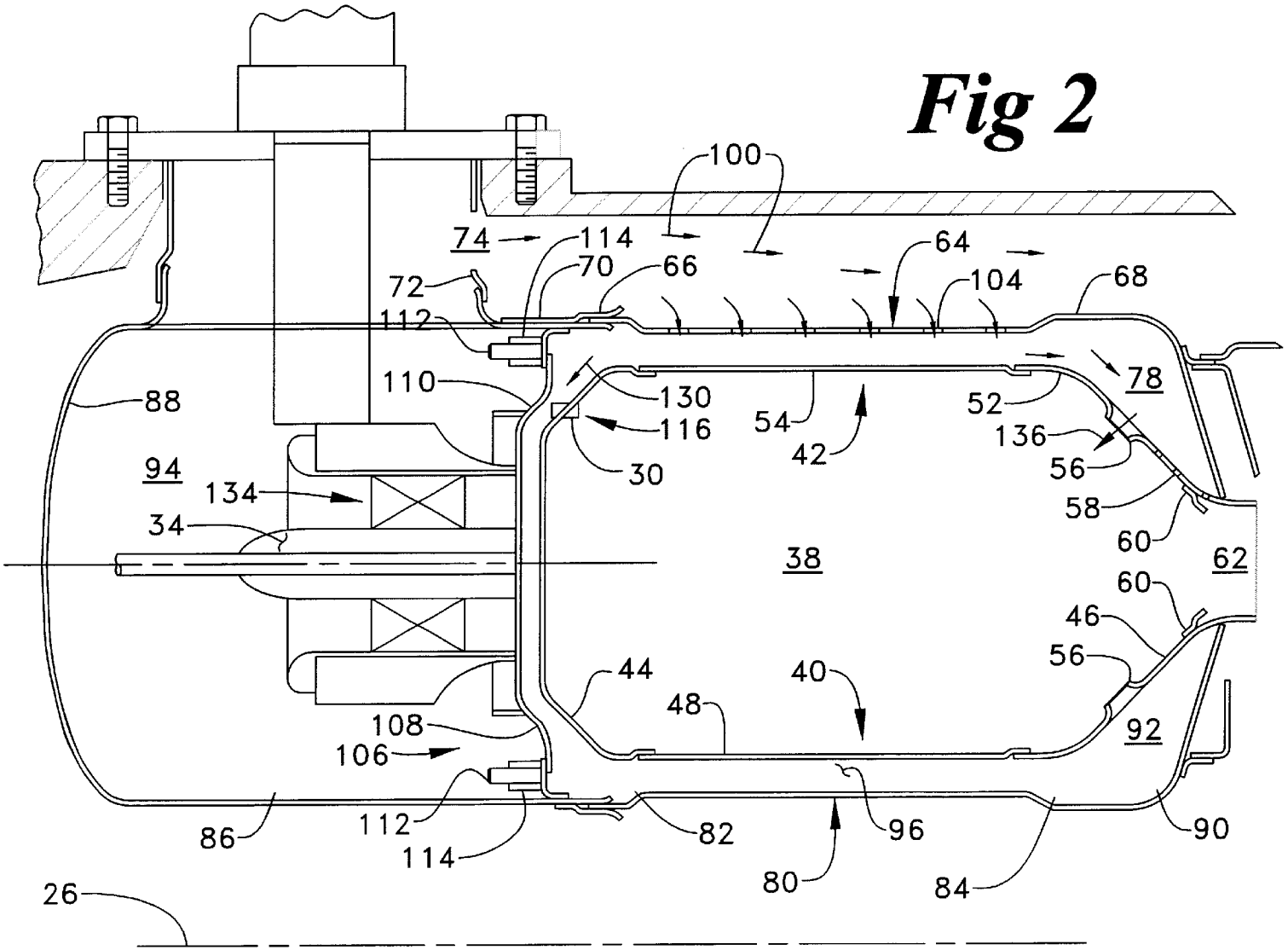
FIG. 2 is an enlarged sectional side view of a combustor section embodying the present invention.

As best shown in FIG. 2, an annular combustion zone 38 is enclosed by an inner combustor liner 40 and an outer combustor liner 42 spaced apart a pre-established distance. The inner combustor liner 40 has an inner inlet conical portion 44 and an inner outlet conical portion 46 axially spaced apart by an inner cylindrical liner portion 48. The inner inlet conical portion connects with fuel nozzle 30 in a normal fashion. The inner outlet conical portion 46 terminates proximate the turbine section 14. While the combustor liners 40, 42 are shown having multiple pieces, the combustor liners may also be made from a single piece of conventional high temperature material without changing the essence of the invention.

Similarly the outer combustor liner 42 has an outer inlet conical portion 50 and an outer outlet conical portion 52 axially spaced apart by an outer cylindrical liner portion 54. The outer inlet conical portion 50 connects in a normal fashion with the fuel nozzle 30. The outer outlet conical portion 52 terminates proximate the turbine section 14. Both the inner outlet conical portion 46 and the outer outlet conical portion 52 define a row of dilution holes 56. The outer outlet conical portion 50 further defines a plurality of rows of effusion cooling holes 58. Aft cooling louvers 60 attach to the outer outlet conical portion 52 and inner outlet conical 46 portion downstream from the effusion cooling holes 58 and the dilution holes 56. The outer outlet conical portion 52 and the inner outlet conical portion 46 define a combustor outlet nozzle 62. The combustor outlet nozzle 62 fluidly connects with the turbine section 14.

As shown further in FIG. 2, an outer cooling shield 64 surrounds the outer cylindrical liner portion 54. The outer cooling shield 64 has a first outer shield portion 66 separated axially from a second outer shield portion 68. The first outer shield portion 66 attaches to a first plenum cylinder 70 in a conventional manner. A first plenum disk 72 attaches to a combustor structure 74 at an outer radius and the first plenum cylinder 70 at an inner radius. The second outer shield portion 68 connects to an outer dilution dome 76. The outer outlet conical portion 52 and the outer dilution dome 76 connect near the turbine section 14. An outer dilution plenum 78 is defined by the outer outlet conical portion 52 and the outer dilution dome 76.

FIG. 2 further shows the inner combustor liner 40 surrounding an inner cooling shield 80. The inner cooling shield 80 has a first inner shield portion 82 axially separated from a second inner shield portion 84. The first inner shield portion 82 connects with a second plenum cylinder 86. A second plenum disk 88 connects the second plenum cylinder 86 with the combustor structure 74. The second inner shield portion 84 connects with an inner dilution dome 90. The inner outlet conical portion 46 and the inner dilution dome 90 connect proximate the turbine section 14 and define an inner dilution plenum 92.

The present embodiment as shown in FIG. 2 further includes fluid chambers. The first plenum cylinder 70, the second plenum cylinder 86, the first plenum disk 72, and the second plenum disk 88 define a combustion air plenum 94. The inner dilution plenum 92 and outer dilution plenum 78 fluidly connect with the combustion air plenum 94 through an inner cooling air passage 96 and an outer cooling air passage 98 respectively. The inner cooling shield 80 and the inner cylindrical liner portion 48 define the inner cooling air passage 96. The outer cylindrical liner portion 54 and the outer cooling shield 64 define the outer cooling air passage 98. An outer air passage 100 and inner air passage 102 fluidly connect with the flow delivery system 12. In this embodiment, the outer air passage 100 and the outer cooling air passage 98 fluidly connect through a plurality of impingement holes 104 in the outer cooling shield 64. Likewise, the plurality of impingement holes 104 fluidly connects the inner cooling air 96 passage with the inner air passage 102.

A flow diverting mechanism 106 further defines the inner cooling air passage 96 and the outer cooling air passage 98. The flow diverting mechanism 106 in this embodiment has an inner diverting cone 108 and an outer diverting cone 110. Each of the diverting cones 108, 110 attaches to a series of regularly spaced apart connecting rods 112. In this application three connecting rods 112 (one shown) attach to the inner diverting cone and three connecting rods 112 (one shown) attach to the outer diverting cone 110 at about one hundred twenty (120) degree intervals. Each of the connecting rods 112 connects slidably with a bushing 114 attached to the combustor structure 74. An actuating device (not shown) connects to the diverting cones 108, 110 and axially moves the diverting cones 108, 110 between a first position and second position. The diverting cones 108, 110 are infinitely movable between the first position and second position. In the first position, the diverting cones 108, 110 define an orifice 116 having a full or maximum flow therethrough as indicated by the cross-sectional area labeled between the arrows as "F" between the cooling air passages 96, 98 and the combustion air plenum 94. In the second position, the diverting cones 108, 110 contact the inlet conical portions 44, 50, and the flow through the orifice 116 is at a minimum.

Figure 3:
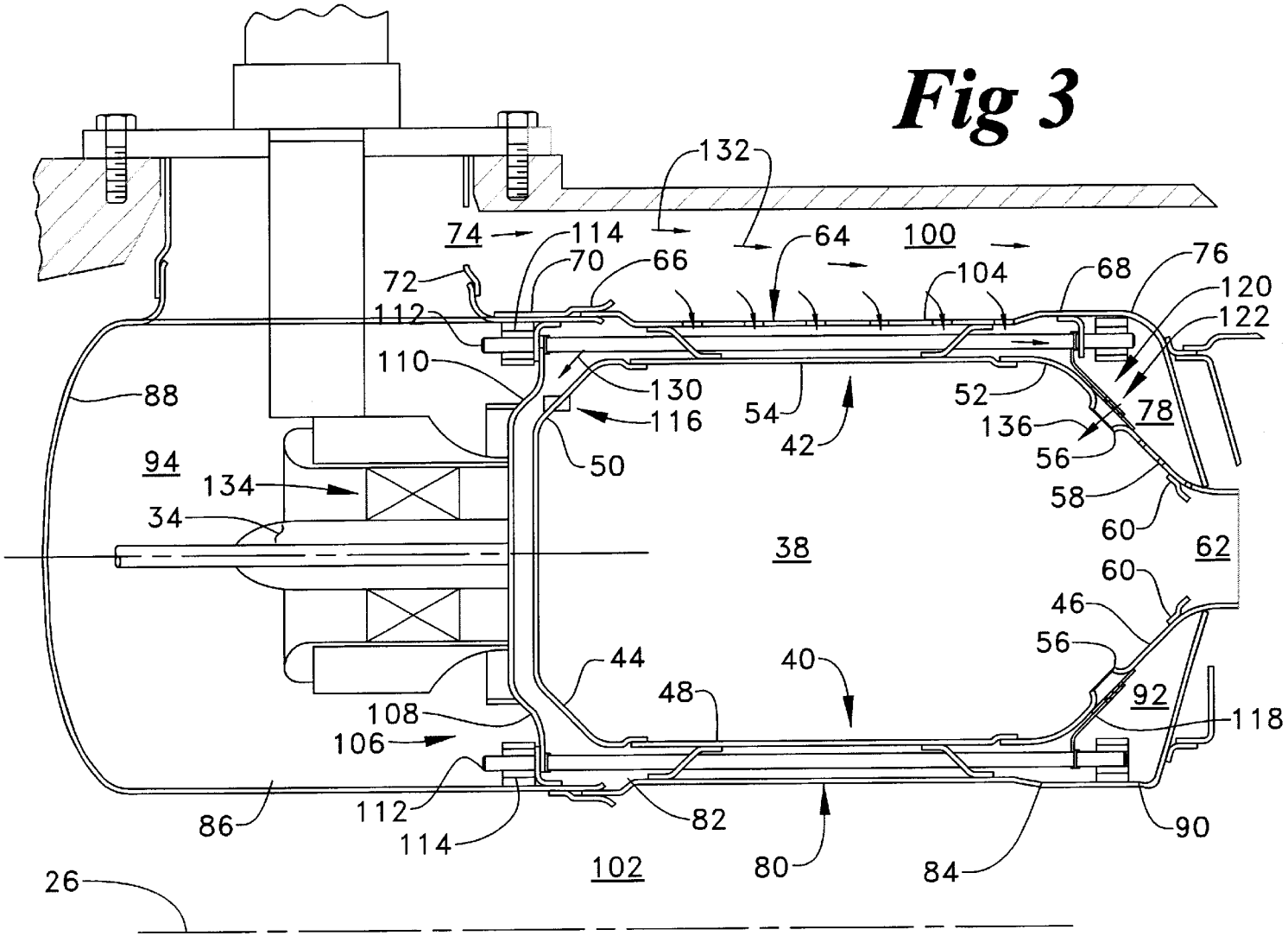
FIG. 3 is an enlarged sectional view of the combustor section showing an alternate embodiment of the present invention.

In another embodiment shown in FIG. 3, the flow diverting mechanism 106 further includes an inner dilution diverting cone 118 and outer dilution diverting cone 120. The connecting rods 112 extend from the inlet conical portions 44, 50 to the outlet conical portions 46, 52. The dilution diverting cones 118, 120 attach to the connecting rods 112 adjacent the outlet conical portions 46, 52. In the first position, the dilution diverting cones 108, 110 abut the outlet conical portions 46, 52 near the row of dilution holes 56. In the second position, the dilution diverting cones 118, 120 are a predetermined distance from the outlet conical portions 46, 52. Optionally, the dilution diverting cones 118, 120 may have a series of small leak holes 122 adjacent to the row of dilution holes 56. The leak holes 122 are substantially smaller than the row of dilution holes 56.

Figure 4:
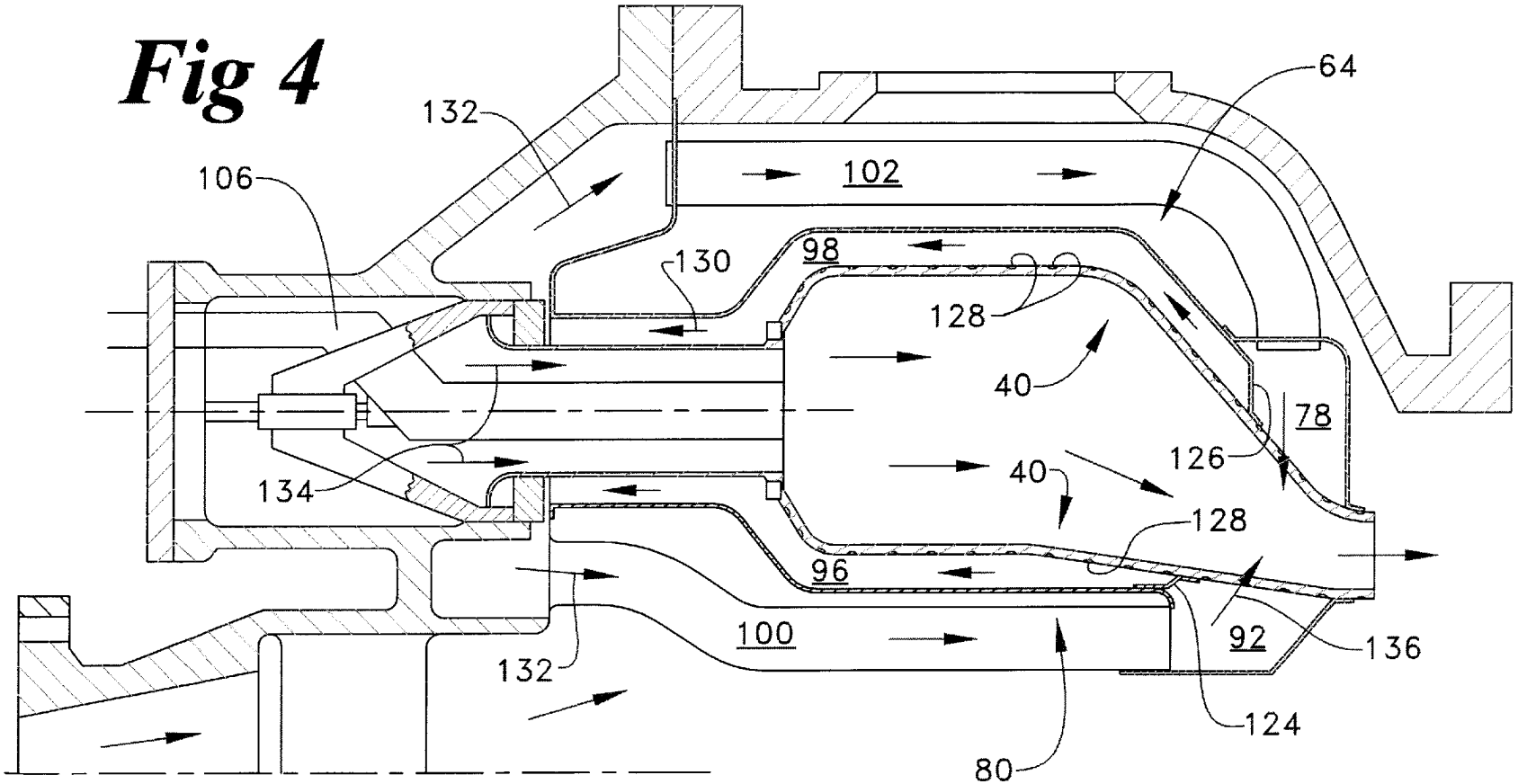
FIG. 4 is an enlarged sectional view of the combustor section showing an another alternate embodiment of the present invention.

FIG. 4 shows another embodiment without impingement holes 104. Instead, the inner air passage 100 and outer air passage 102 connect with the inner dilution plenum 92 and outer dilution plenum 78 respectively. An inner duct 124 or passage fluidly connects the inner dilution plenum 92 with the inner cooling air passage 96. Similarly, an outer duct 126 or passage fluidly connects the outer dilution plenum 78 with the outer cooling air passage 98. In this embodiment, the cooling air passages 96, 98 have a plurality of turbulation devices 128 disposed therein. In the preferred embodiment, the turbulation devices 128 are a plurality of dimples or concavities disposed on the combustor liners 40, 42 adjacent the cooling shields 64, 80. Other turbulation devices 128 include trip strips, turbulators, swirlers or other conventional methods of increasing convection between a cooling air flow 130 and the combustor liners 40, 42.

Industrial Applicability

The combustor 24 of this application improves flexibility in the use of a compressed air flow 132 supplied by the compressor section. This invention uses the compressed air flow 132 for both the cooling air flow 130 and a combustion air flow 134. Furthermore, apportionment of the compressed air flow 130 may be varied according to engine operating conditions.

In normal operation, the flow diverting mechanism 106 will operate in the first position. The compressed air flow 132 will move through the air flow delivery system 12 into the air passages 100, 102. Cooling air flow 130 will pass through the impingement holes 104 and impact the combustor liners 40, 42. The cooling air flow 130 divides into the combustion air flow 134 and a dilution air flow 136. The combustion air flow 134 passes through the orifice 116 into the combustion air plenum 94. The dilution air flow 136 passes into the dilution air plenums 78, 92. The combustion air flow 134 mixes with fuel from the fuel nozzle 30 to form a fuel air mixture. The fuel air mixture is combusted in the annular combustion zone 38. The dilution air flow 136 passes through the row of effusion cooling holes 58, the aft cooling louver 60, and the row of dilution holes 56. The dilution air flow 136 from the row effusion cooling holes 58 maintains skin temperatures of outlet conical portions 46, 52. The dilution air flow 136 from the row of dilution holes 56 assures temperatures entering the turbine section 14 meet a predetermined profile.

As engine operating condition increases, such as loading decreases, the flow diverting mechanism 106 moves towards the second position where the diverting cones 108, 110 move toward the inlet conical portions 44, 50. The convergence of the diverting cones 108, 110 and the inlet conical portions 44, 50 reduces the full flow orifice 116. Reduction of the cooling air flow 136 through the orifice 116 increases pressure in the cooling air passages 96, 98. The pressure increase in the cooling air passages 96, 98 reduce both the cooling air flow 130 and combustion air flow 134. As the combustion air flow 134 decreases, the fuel air mixture becomes richer and combustion becomes more stable.

In the embodiment shown in FIG. 3, control is further improved by controlling dilution air flow 136 into the annular combustion zone 38 along with the cooling air flow 130 and combustion air flow 134 similar to that of the first embodiment. As in the first embodiment, the combustion air flow 134 passes from the cooling air passages 96, 98 into the combustion air plenum 94. The combustion air flow 134, however, increases because pressures in the dilution plenums 78, 92 increase as the row of dilution holes becomes 56 obstructed by the dilution diverting cones 118, 120. Under this condition, the dilution air flow 136 only passes through the row of effusion holes 58 and the aft cooling louver 60. Optionally, some of the dilution air flow 136 may pass through the leak holes 122 if minimal dilution air flow 136 is need to establish the predetermined profile.

In FIG. 4, the shown embodiment uses convection cooling techniques instead of impingement cooling of the combustor liners 40, 42. Convection cooling reduces pressure losses associated with impingement cooling. In this embodiment, the compressed air flow 132 in the air passages 100, 102 enters the dilution plenums 78, 92. The cooling air flow passes through the ducts into the cooling air passages 96, 98. The cooling air flow 130 in this embodiment is also the combustion air flow 134. The flow diverting mechanism 106 operates in a manner similar to that in FIG. 1. In the first position, the orifice 116 allows cooling air flow 132 to move from the dilution plenums 78, 92 through the ducts 124, 126 into the cooling air passages 96, 98. The cooling air flow 130 convectively cools the combustor liners 40, 42. The concavities 128 enhance convection by increasing local velocities of the cooling air flow 130 and mixing the cooling air flow near the combustor liners 40, 42 with the cooling air flow near the cooling shields 64, 68.

As the flow diverting mechanism 106 moves toward the second position, the orifice 116 reduces in flow area. The increasing restriction of the orifice 116 increases pressures in the cooling air passages 96, 98. With the increasing pressure, less cooling air flow 130 passes from the dilution plenums 78, 92 into the cooling air passages 96, 98. As stated earlier, this improves flame stability during decreased engine loading.

Other aspects, objects and advantages of this invention can be obtained from a study of the drawings, the disclosure and the appended claims.

What is claimed is:

1. A combustor for a gas turbine engine comprising:

a combustor liner, said combustor liner having an inlet end portion and an exit end portion, said combustor liner defining a combustion zone therein;

cooling air passage being defined by a cooling shield and said combustor liner, said cooling air passage having a plurality convection enhancing devices being disposed on said combustor liner;

an air passage being fluidly connected with said cooling air passage proximate said exit end portion;

a combustion air plenum being fluidly connected with said cooling air passage proximate said inlet end portion, said combustion air plenum being fluidly connected with said combustion zone;

a flow diverting mechanism being positioned intermediate said cooling air passage and said combustion air plenum, said flow diverting mechanism being movable between a first and second position, said first position allowing fluid communication between said cooling air passage and said combustion air plenum, said second position preventing fluid communication between said combustion air plenum and said cooling air passage.

2. The combustor as specified in claim 1 further comprising a dilution plenum being fluidly connected with said combustion zone proximate said exit end portion.

3. The combustor as specified in claim 2 wherein said fluid connection being a dilution hole defined by said combustor liner.

4. The combustor as specified in claim 3 wherein said flow diverting mechanism preventing fluid communication between said dilution plenum and said dilution hole where said flow diverting mechanism being in said first position.

5. The combustor as specified in claim 1 wherein said flow diverting mechanism having a conical section proximate said combustion air plenum, said conical section being adapted to move axially, said conical section moving into contact with said combustor liner where said flow diverting mechanism being in said second position.

6. The combustor as specified in claim 5 wherein said flow diverting mechanism having a second conical section proximate a dilution hole, said second conical section being adapted to at least partially cover said dilution hole where said flow diverting mechanism being in said first position.

7. The combustor as specified in claim 5 wherein said second conical section being connected with said first conical section by a plurality of evenly spaced connecting rods.

8. The combustor as specified in claim 5 wherein said second conical section having at least one leak hole, said leak hole being adapted to fluidly connect said dilution plenum and said dilution hole.

9. The combustor as specified in claim 1 wherein said plurality of convection enhancing devices being a plurality of regularly spaced concavities on said combustor liner.

10. The combustor as specified in claim 1 wherein said combustor being an annular type combustor.

* * * * *

UNITED STATES PATENT AND TRADEMARK OFFICE

CERTIFICATE OF CORRECTION

PATENT NO. : 6,314,716 B1
DATED : November 13, 2001
INVENTOR(S) : Mario E. Abreu et al.

It is certified that error appears in the above-identified patent and that said Letters Patent is hereby corrected as shown below:

Column 5,
Line 47, insert -- a -- before the first instance of the word "cooling"

Signed and Sealed this

Fourth Day of June, 2002

*Attest:*

*Attesting Officer*

JAMES E. ROGAN
*Director of the United States Patent and Trademark Office*